US006276333B1

(12) United States Patent
Kazama et al.

(10) Patent No.: US 6,276,333 B1
(45) Date of Patent: Aug. 21, 2001

(54) THROTTLE CONTROL FOR ENGINE

(75) Inventors: Isamu Kazama; Hiroshi Iwano, both of Kanagawa; Hiraku Ooba, Yokohama, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/383,187

(22) Filed: Aug. 26, 1999

(30) Foreign Application Priority Data

Sep. 17, 1998 (JP) ..... 10-263352

(51) Int. Cl.[7] ..... F02D 9/10
(52) U.S. Cl. ..... 123/399
(58) Field of Search ..... 123/399, 492

(56) References Cited

U.S. PATENT DOCUMENTS

| | | | | |
|---|---|---|---|---|
| 5,150,680 | | 9/1992 | Nishimura . | |
| 5,623,905 | | 4/1997 | Kau et al. . | |
| 5,775,293 | * | 7/1998 | Kresse | 123/399 |
| 5,899,830 | * | 5/1999 | Tabata | 123/399 |
| 5,983,861 | * | 11/1999 | Nishio et al. | 123/399 |
| 5,992,384 | * | 11/1999 | Bauer et al. | 123/399 |
| 6,058,349 | * | 5/2000 | Kikori et al. | 123/399 |

FOREIGN PATENT DOCUMENTS

| | | |
|---|---|---|
| 35 04 195 | 9/1985 | (DE) . |
| 41 02 910 | 8/1991 | (DE) . |
| 43 33 896 | 4/1995 | (DE) . |
| 0 189 190 | 7/1986 | (EP) . |
| 3-140664 | 6/1991 | (JP) . |
| 4-101037 | 4/1992 | (JP) . |
| 5-231225 | 9/1993 | (JP) . |
| 9-287513 | 11/1997 | (JP) . |

* cited by examiner

*Primary Examiner*—Erick Solis
(74) *Attorney, Agent, or Firm*—Foley & Lardner

(57) ABSTRACT

A throttle actuator varies an actual throttle valve opening degree for an engine in response to a control signal independently of driver's accelerator operation. An engine control unit determines a target torque (or a variable quantity representing the target torque) in accordance with an accelerator opening degree, and normally controls the actual throttle opening degree in a normal mode based on the target torque. In a predetermined operating region where the throttle opening responds too sensitively to a change in the target torque, the control unit controls the throttle opening degree in a constraint mode in accordance with a parameter, such as the accelerator opening degree, independent of the target torque.

13 Claims, 13 Drawing Sheets

THROTTLE CONTROL FOR ENGINE

BACKGROUND OF THE INVENTION

The present invention relates to engine controlling technique, and more specifically to system and/or process for controlling a throttle valve opening degree.

A Japanese Patent Kokai Publication No. 4(1992)-101037 shows an engine control system for determining a target throttle opening degree based on a target engine torque calculated in accordance with an accelerator opening degree.

SUMMARY OF THE INVENTION

When the relation between the throttle valve opening degree and engine torque is not linear as shown in FIG. 15, minute fluctuation in the target torque in a large throttle opening range can cause an excessive response of the throttle valve opening degree, resulting in unwanted torque fluctuation. This is due to such a curvilinear characteristic that, in the small throttle opening range in which the throttle opening is relatively small, a change induced in the throttle opening degree by a change in the engine torque is relatively small, and the ratio of the responsive change in the throttle opening degree to the change in the engine torque becomes greater in the large opening range.

It is an object of the present invention to provide apparatus and/or method for preventing excessive response in a throttle valve opening degree to minute changes in an input parameter such as a target torque.

According to the present invention, an engine control apparatus comprises: an actuator for controlling an actual throttle opening degree in response to a throttle control signal, independently of accelerator operation; an accelerator input device (such as items 7 and 12) for producing an accelerator signal representing an accelerator opening degree varying from a minimum degree to a maximum degree corresponding to a throttle opening degree of a fully open throttle valve position; a target quantity calculating section for calculating a target torque representative quantity representative of a target torque in accordance with the accelerator opening degree represented by the accelerator signal; a first target opening determining section for calculating a first mode target throttle opening degree in accordance with the target torque representative quantity; an output section for determining a desired target throttle opening degree in accordance with the first mode target throttle opening degree and for producing the throttle control signal in accordance with the desired target throttle opening degree to reduce a deviation of the actual throttle opening degree from the desired target throttle opening degree; a discriminating section for monitoring the target torque representative quantity to examine whether a predetermined condition is satisfied, and a modifying section for modifying the control characteristic when the predetermined condition is satisfied. According to one aspect of the present invention, the discriminating section is arranged to judge a first condition to be satisfied when the target torque representative quantity is equal to or greater than a threshold representative quantity, and the accelerator opening degree is equal to or greater than a threshold opening degree; and the modifying section is in the form of a second determining section for determining a second mode target throttle opening degree in accordance with the accelerator opening degree when the first condition is satisfied, and for substituting the second mode target throttle opening degree, as the desired target throttle opening degree, for the first mode target throttle opening degree when the first condition is satisfied. According to another aspect of the invention, the discriminating section judges a predetermined second condition to exist when the target torque representative quantity is equal to or greater than a threshold representative quantity, and the accelerator opening degree is smaller than a threshold degree; and the modifying section includes a limiting section for limiting the target torque representative quantity to the threshold representative quantity.

The target torque representative quantity is a quantity representative of the target torque, such as the target torque per se, the ratio of the target torque to a maximum torque and an intake air flow ratio.

According to still another aspect of the present invention, an engine control apparatus comprises: means for calculating a target torque representative quantity; controlling means for determining a control input in accordance with the target torque representative quantity, for determining a control output representing a desired target throttle opening degree from the control input according to a predetermined nonlinear characteristic of the control output with respect to the control input, for producing a throttle control signal in accordance with the control output; condition discriminating means for producing a condition signal when the target torque representative quantity is equal to or greater than the threshold representative quantity; and constraining means for constraining said controlling means to determine the control output in accordance with one of the accelerator opening degree and the threshold representative quantity, independently of the target torque representative quantity when the condition signal is present.

An engine control process according to one aspect of the invention comprises: calculating a target torque representative quantity; preparing a control input in accordance with the target torque representative quantity; determining a control output representing a desired target throttle opening degree from the control input according to a predetermined characteristic; producing a throttle control signal in accordance with the control output; comparing the target torque representative quantity with a threshold representative quantity to produce a condition signal when the target torque representative quantity is equal to or greater than the threshold quantity; and constraining one of the control input and the control output so that the control output is determined independently of the target torque representative quantity when the condition signal is present.

DETAILED DESCRIPTION OF THE INVENTION

Figure 1:
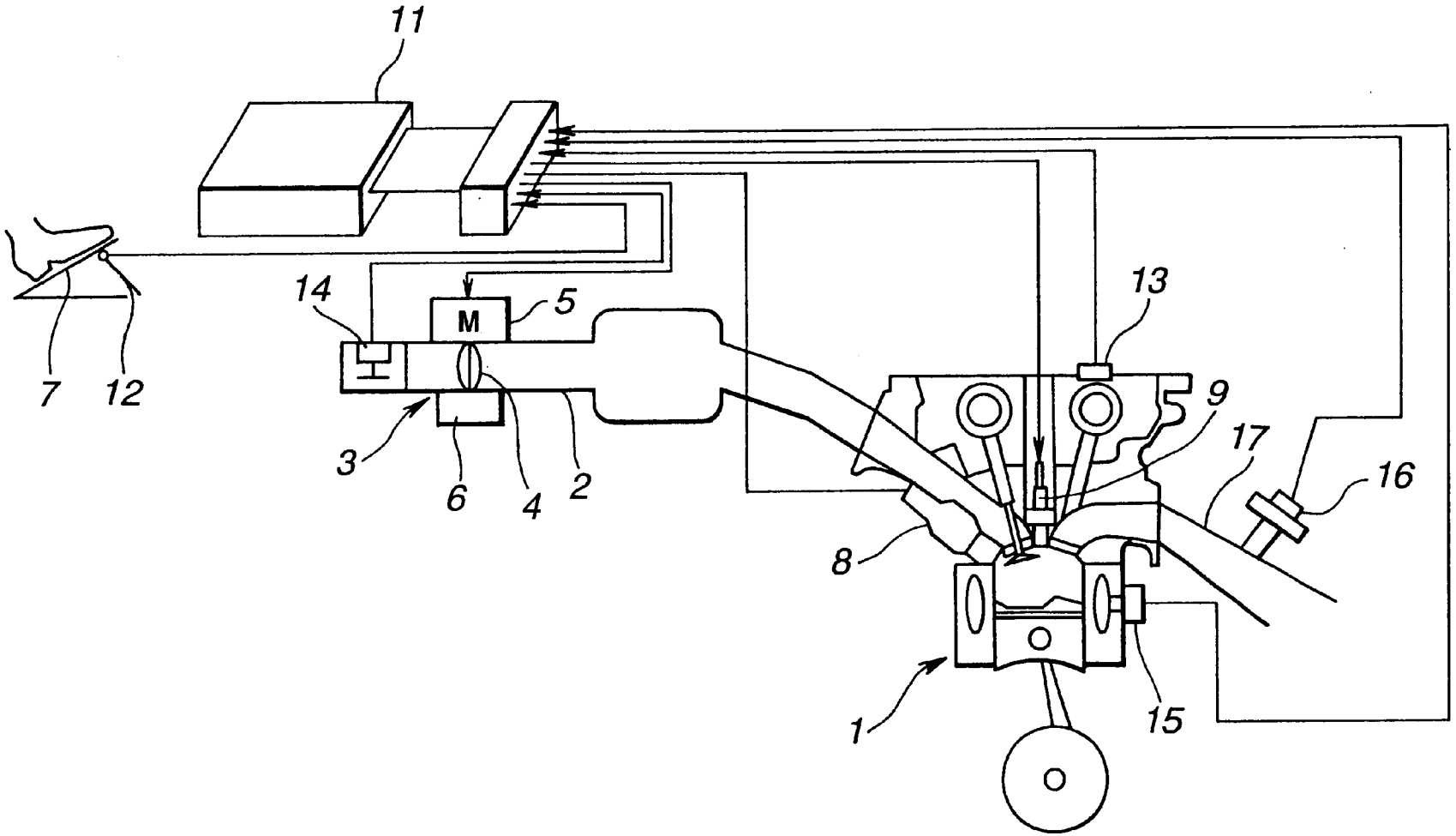
FIG. 1 is a schematic view showing an engine system according to a first embodiment of the present invention.

FIG. 1 shows an engine system according to a first embodiment of the present invention.

The engine system of this example is a prime mover for a motor vehicle. The engine system includes an engine (engine proper or engine block assembly) 1, an intake passage 2 for the engine 1 and an electronically controlled throttle apparatus 3 for moving a throttle valve 4 in the intake passage 2 with a motor 5. The electronically controlled throttle apparatus 3 drives the throttle valve 4 so as to reduce a deviation of the actual throttle opening degree sensed by a throttle sensor 6 from a desired target throttle opening degree dictated by a control unit 11. By controlling the throttle opening, this engine system can vary the intake air quantity for the engine 1 and thereby control the output shaft torque of the engine 1.

An accelerator (pedal) 7 is provided with an accelerator sensor 12. This accelerator sensor 12 senses the accelerator opening degree (or accelerator depression degree, or driver's accelerator input). When the accelerator opening degree is maximum, the accelerator opening signal produced by this accelerator sensor 12 represents a value corresponding to the fully open position of the throttle valve 4. When, for example, the throttle opening degree is 80° at the fully open position, then the accelerator opening signal of the accelerator sensor 12 represents 80° at the maximum accelerator opening degree. The accelerator opening signal of the accelerator sensor 12 in this example is proportional to the accelerator opening degree or accelerator depression degree.

The control unit 11 receives input information on the accelerator opening and the engine revolution speed from the accelerator sensor 12 and a crank angle sensor 13. By using the input information, the control unit 11 calculates a target throttle opening degree for the throttle valve 4. In accordance with the calculated target throttle opening degree (command), the control unit 11 controls the actual throttle opening degree of the throttle valve 4 to control the engine output in the following manner.

In the example shown in FIG. 1, there are further provided: an air flow meter 14 disposed on the upstream side of the throttle unit 3 for sensing the intake air quantity to the engine 1, a temperature sensor 15 for sensing the temperature of an engine cooling water, and an oxygen sensor 16 disposed in an exhaust passage 7 for sensing the oxygen content of exhaust gases from the engine 1. Data on these engine operating conditions is relayed to the control unit 11. In accordance with the data, the control unit 11 determines a target air fuel ratio at a stoichiometric level or on a lean side, calculates a fuel supply quantity required to produce an air fuel mixture of the target air fuel ratio in proportion to the intake air quantity, and drives a fuel injector 8 to carry out fuel injection in accordance with the calculated quantity. A spark plug 9 ignites the fuel mixture under the command of the control unit 11.

Figure 2:
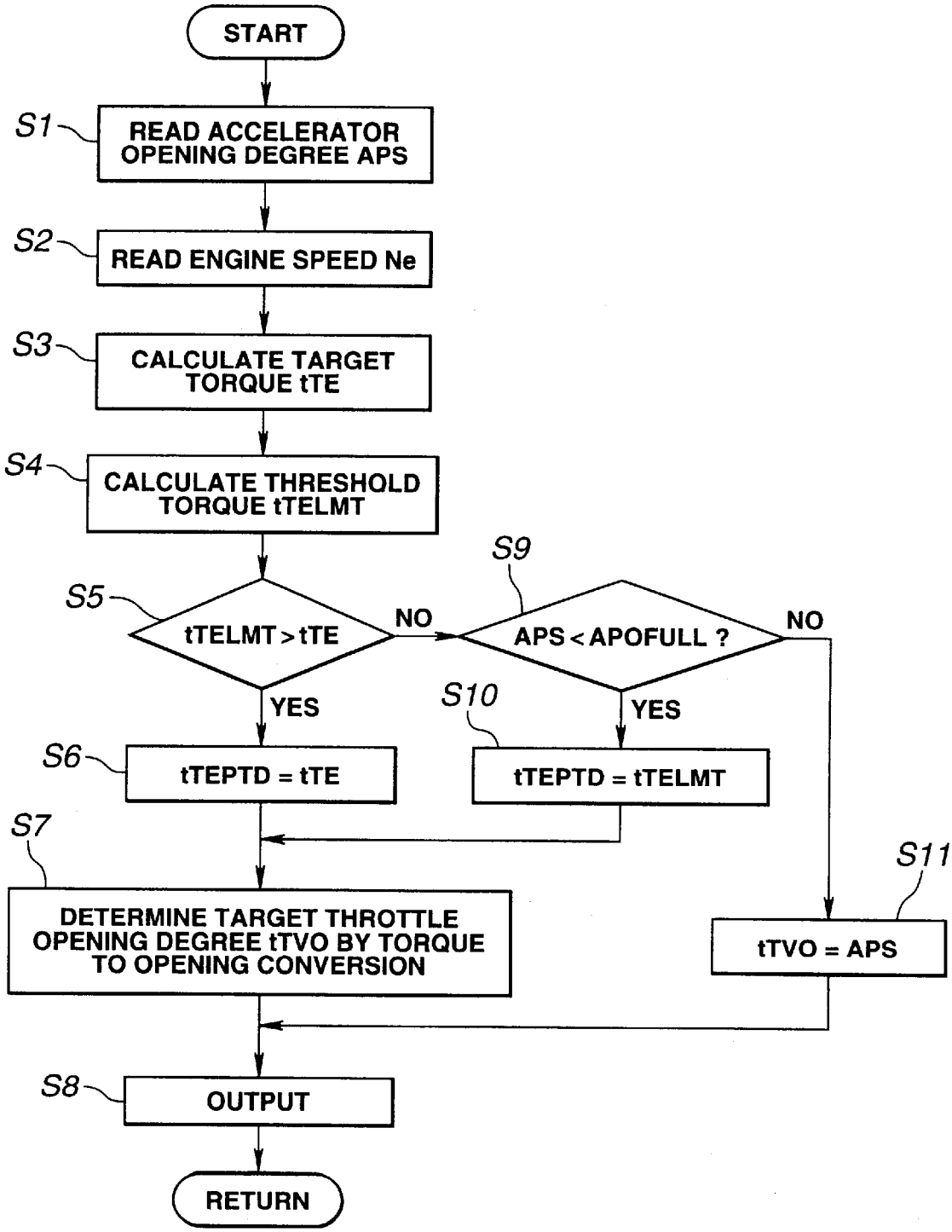
FIG. 2 is a flowchart of a throttle opening control process according to the first embodiment.

FIG. 2 shows the throttle control process carried out in the control unit 11. The process of FIG. 2 is executed to determine the target throttle opening degree tTVO at regular intervals of a predetermined time length (4 ms, for example).

Steps S1 and S2 are for reading the accelerator opening degree APS and the engine revolution speed (rpm) Ne.

A step S3 is for calculating a target torque tTE in accordance with the accelerator opening degree APS and the engine speed Ne. One method for calculating tTE is data retrieval from a map of data on the target torque including, as parameters, the accelerator opening degree APS and the engine speed Ne. Another method employs the following mathematical relationship, as disclosed in the Japanese Patent Kokai Publication NO. 4-101037.

$$tTE=K1\times APS-K2\times Ne$$

In this equation, K1 and K2 are coefficients determined in accordance with vehicle parameters.

A step S4 is a step for calculating a threshold torque (value) tTELMT. A step S5 is for comparing the target torque tTE with the threshold torque tTELMT.

The threshold torque tTELMT is set at a limit level above which excessive fluctuation in the throttle opening is caused by fluctuation of the target torque. Studies of the inventors of the present application show that a desired value of the threshold torque is smaller by several % than the maximum torque though the demarcation is influenced by the resolution of the target torque and throttle opening.

Figure 15:
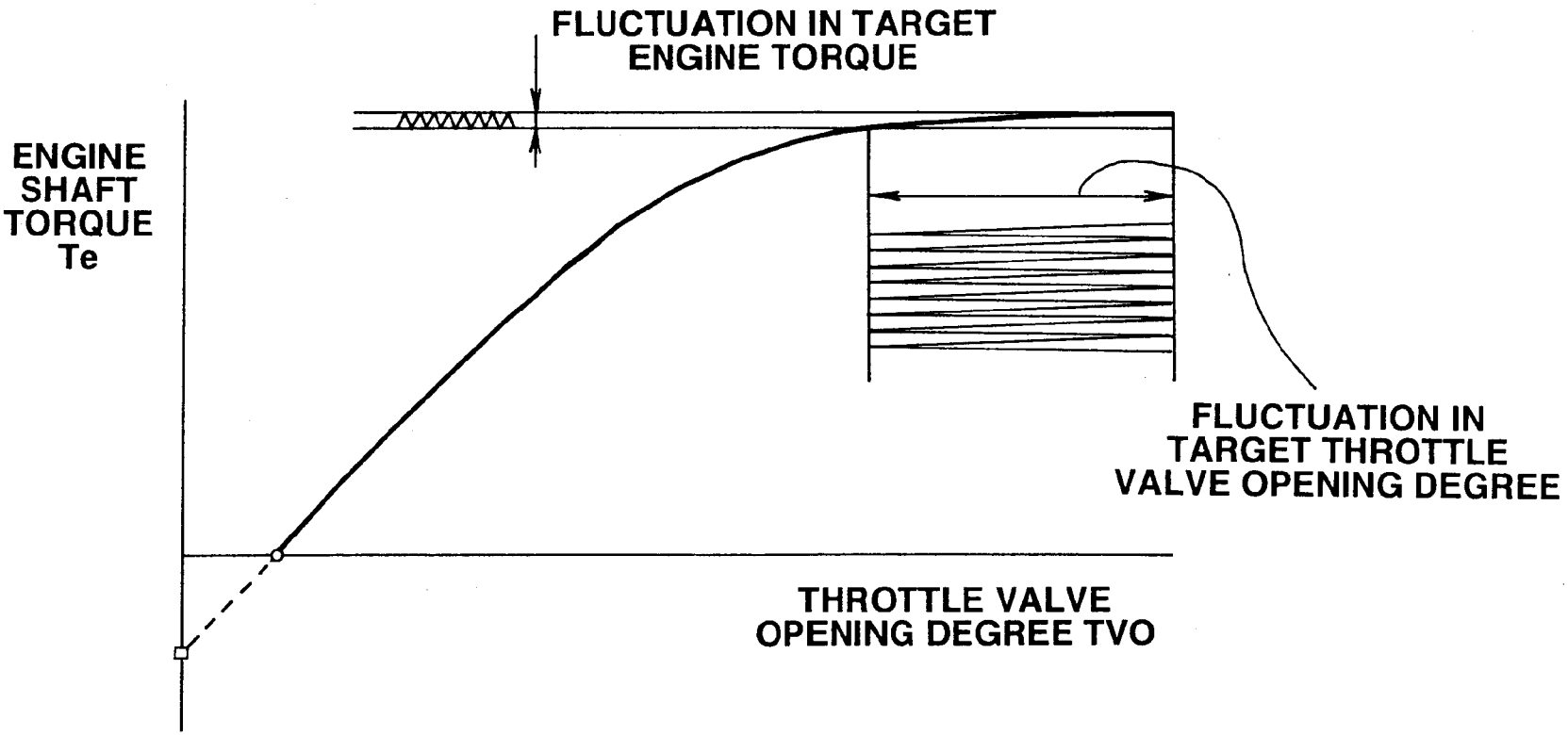
FIG. 15 is a graph showing of a throttle valve opening degree with respect to an engine torque in an underlying technology.

The reason for undesired fluctuation of the throttle opening is not that the fluctuation of the target torque is greater near the maximum. The target torque always fluctuates to some extent over the entire torque range due to bit errors in computation and flicker in sensor signals. It is a difference in the sensitivity of the throttle opening that causes greater fluctuation in a higher torque region near the maximum. The sensitivity is much greater in the higher torque region near the maximum torque than in a lower torque region near the minimum torque. In the higher torque region, a change in the target torque causes an amplified change in the throttle opening, as shown in FIG. 15. The threshold torque tTELMT defines a torque region in which the sensitivity is too high.

Figure 3:
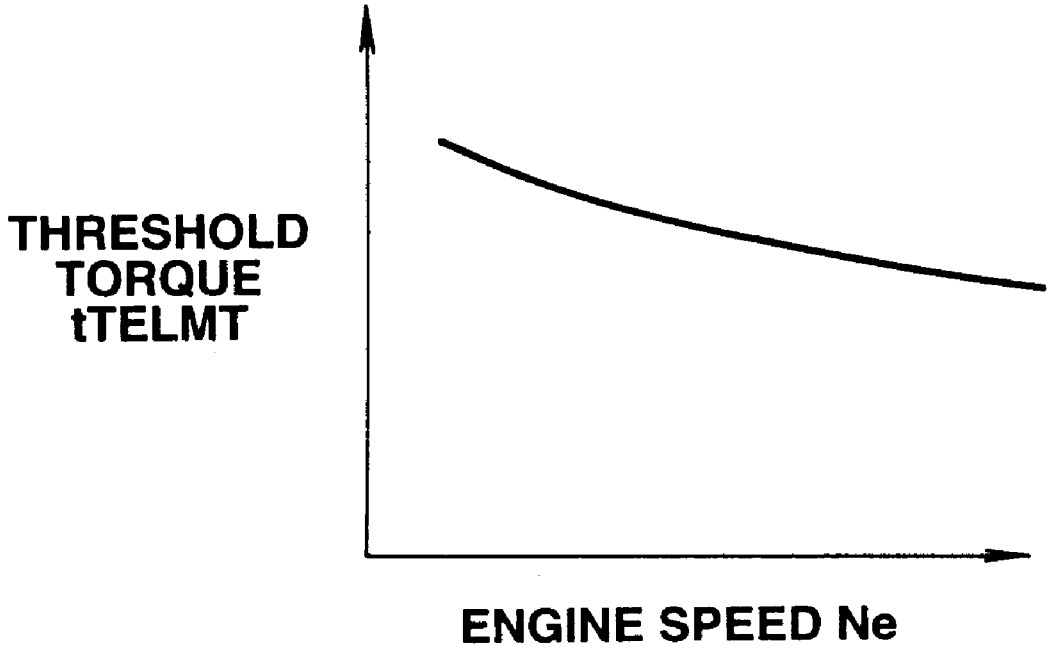
FIG. 3 is a graph showing a threshold torque tTELMT which can be employed in the control process of FIG. 2.

In this example, the threshold torque tTELMT is determined in accordance with the engine speed by lookup from a table storing a relationship between tTELMT and the engine speed Ne as shown in FIG. 3. In the example of FIG. 3, the threshold torque tTELNT decreases monotonically with increase in the engine speed Ne. The threshold torque tTELMT in this example is determined as a function of the engine speed because the maximum torque (that is, the torque obtained at the fully open throttle condition) varies in dependence on the engine speed. However, it is optional to employ a constant value as the threshold torque tTELMT for simplification.

When the target torque tTE is smaller than the threshold torque tTELMT, the control unit 11 proceeds from the step S5 to steps S6, S7 and S8 to perform the normal throttle valve control. The control unit 11 stores the target torque tTE as a second (or final) target torque labeled tTEPTD at the step S6, determines the target throttle opening degree tTVO in accordance with the thus-obtained second target torque tTEPTD and the engine speed Ne at the step S7 and transfers this target throttle opening degree tTVO to an output register. It is possible to employ a known method for calculating a throttle opening degree (such as tTVO) from a torque (such as tTEPTD). In this example, the target throttle opening degree tTVO is determined by a table lookup from a map of tTVO having as parameters the engine torque and engine speed.

The target throttle opening degree tTVO in the output register is outputted to a drive unit in the electronically controlled throttle apparatus 3, which controls the throttle valve 4 so as to reduce to zero the deviation of the actual throttle opening degree sensed by the throttle sensor 6 from the target throttle opening degree tTVO.

When the target torque tTE is equal to or greater than the threshold tTELMT, the control unit 11 proceeds from the step S5 to a step S9 and determines the target throttle opening tTVO in a special mode (or constraint mode) different from the normal mode of steps S6 and S7. At the step S9, the control unit 11 compares the accelerator opening degree APS with a threshold accelerator opening degree APOFULL.

The threshold opening degree APOFULL is determined in relation to a threshold-torque-generating accelerator opening degree which is a value of the accelerator opening degree APS corresponding to the threshold torque tTELMT, determined by conversion from the threshold torque tTELMT. In the example in which the threshold torque tTELMT is dependent on the engine speed, it is possible to set the threshold accelerator opening degree APOFULL equal to the greatest value among values of the accelerator opening degree corresponding to values of the threshold torque tTELMT determined in accordance with levels of the engine speed. In this case, the threshold accelerator opening APOFULL is constant. However, it is optional to determine the threshold accelerator opening in accordance with the engine speed like the determination of tTELMT. (As explained later, it is preferable to set APOFULL greater than the greatest accelerator opening value corresponding to tTELMT.)

When the accelerator opening degree APS is smaller than the threshold accelerator opening degree APOFULL, the control unit 11 proceeds from the step S9 to a step S10 and stores the threshold torque tTELMT as the second (or final) target torque tTEPTD. After the step S10, the control unit 11 proceeds to the steps S7 and S8. Therefore, the target throttle opening degree tTVO is set at the value corresponding to the threshold torque tTELMT. Thus, the target throttle opening degree tTVO is limited to the value corresponding to tTELMT.

When the accelerator opening degree APS is equal to or greater than the threshold accelerator opening degree APOFULL, the control unit 11 proceeds from the step S9 to a step S11, stores the then-existing value of the accelerator opening degree APS directly as the target throttle opening degree (tTVO=APS), and proceeds to the step S8, bypassing the step S7.

FIGS. 4A–4D, and FIGS. 5A–5D illustrate operations of the control system according to the first embodiment.

Figure 4A:
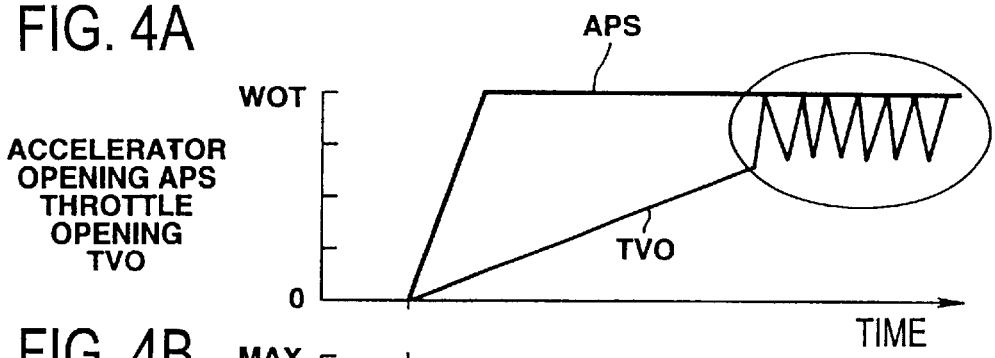
FIGS. 4A–4D are graphs for illustrating effects of the control process of FIG. 2 when the accelerator pedal is depressed from the idle position to a fully depressed position, and thereafter held fully depressed.
Figure 4B:
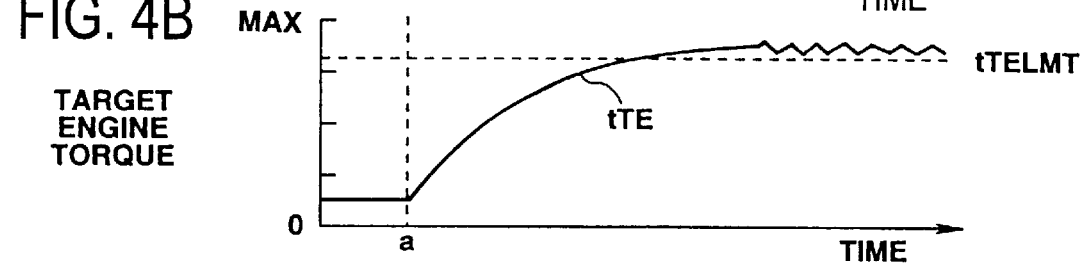

In the case of FIGS. 4A–4D, the accelerator pedal is depressed like a step change, from the idle condition to the maximum degree at a time point a, and held at the maximum degree thereafter. In response to this change of the accelerator opening degree APO, the target torque tTE increases approximately in the form of a first order lag. In the process, the actual throttle opening degree TVO would oscillate largely, in the range of the target torque near the maximum value, under the influence of minute fluctuation in the target torque if the normal throttle control of the step S6 is continued as shown in FIG. 4A.

Figure 4C:
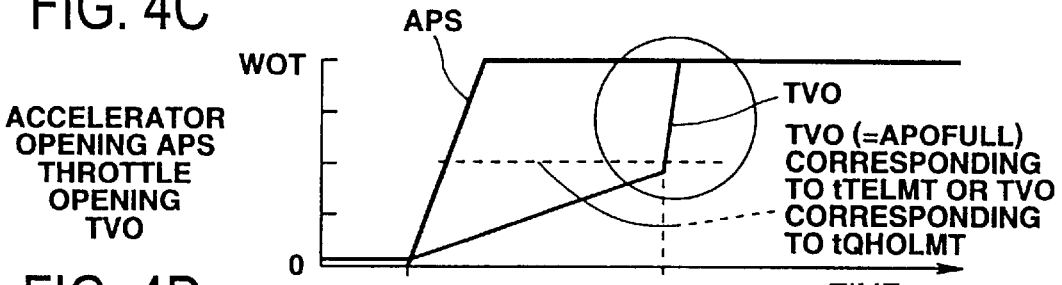
Figure 4D:
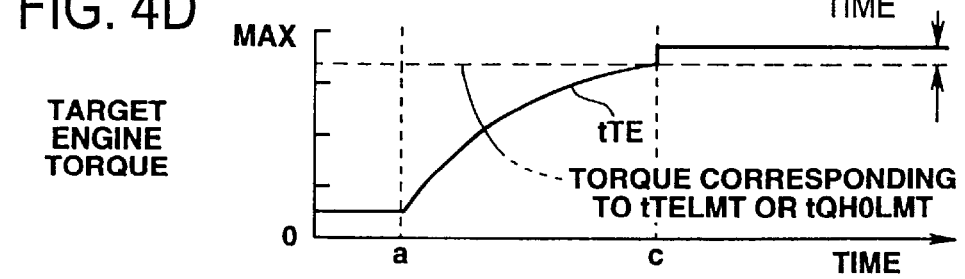

Such oscillation is prevented in the control system according to the first embodiment, as shown in FIGS. 4C and 4D. At a time point c shown in FIGS. 4C and 4D, the target torque tTE becomes equal to or greater than tTELMT, so that the condition is satisfied that tTE≧tTELMT and APS≧APOFULL (APOFULL shown in FIG. 4C is the throttle opening degree corresponding to tTELMT). Therefore, the target throttle opening degree tTVO is determined directly by the value of the accelerator opening degree APO. At the time point c, the accelerator pedal is still held at the fully open position (corresponding to the fully open throttle valve position WOT). Therefore, the actual throttle opening degree TVO (=tTVO) is increased to the maximum value of the fully open position (WOT) like a step change and then held at the maximum value. In response to this change of the throttle opening degree TVO, the actual engine torque increases to the maximum torque in the form of a first order lag. When tTE≧tTELMT and at the same time APS≧APOFULL, the control system according this embodiment controls the throttle opening degree in accordance with the accelerator opening degree, instead of the target torque tTE, and by so doing prevents excessive reaction of the throttle valve to a small change in the target torque to ensure good driveability.

In the example of FIGS. 5A–5D, the accelerator pedal is depressed at a time point e to a predetermined degree to start the vehicle from a standstill state. In this case, the target torque tTE rises sharply to a level near the maximum value at the initial stage of the starting operation since the vehicle speed is 0 km/h at the initial stage. Thereafter, the target torque tTE decreases with increase in the vehicle speed until the target torque tTE settles into an equilibrium state or a steady state at a certain vehicle speed level.

Figure 5A:
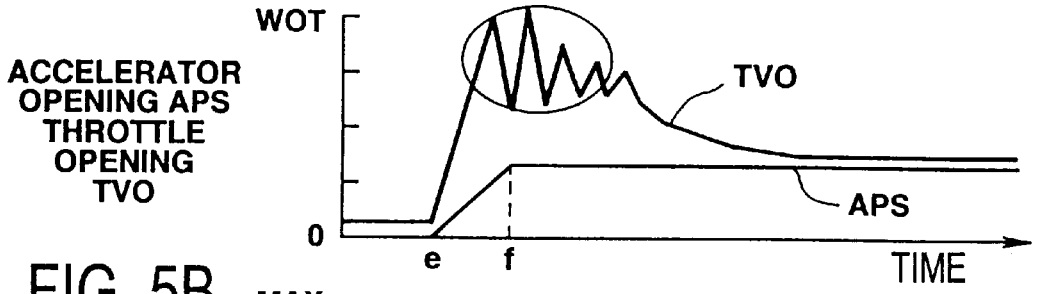
FIGS. 5A–5D are graphs for illustrating effects of the control process of FIG. 2 when the accelerator pedal is depressed to start a vehicle.
Figure 5B:
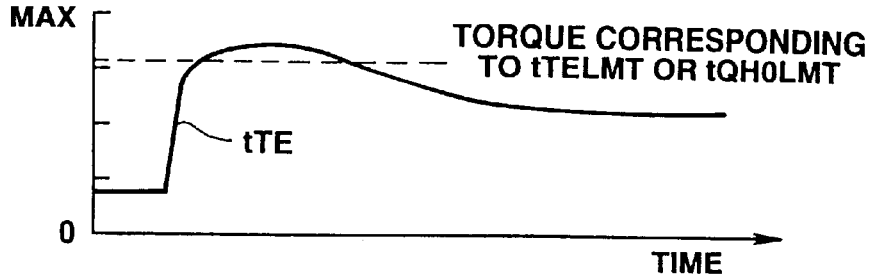

As shown in FIGS. 5A and 5B, continuation of the normal throttle control would cause excessive oscillation of the throttle valve responsive to minute fluctuation during a period during which the target torque tTE is close to the maximum.

Figure 5C:
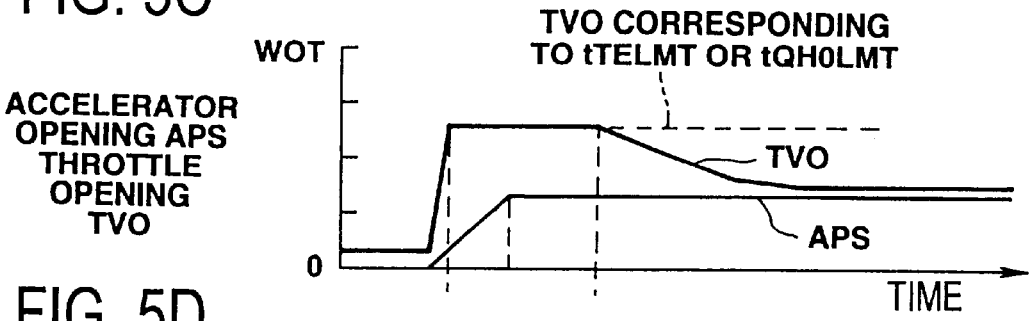
Figure 5D:
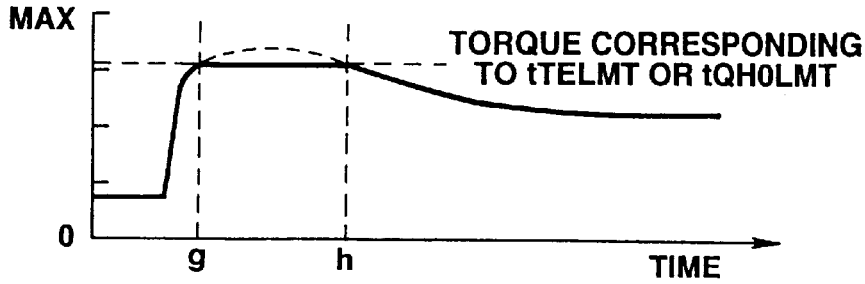

By contrast, in the control system according to this embodiment, as shown in FIGS. 5C and 5D, the requirements of tTE≧tTELMT and APS<APOFULL are satisfied during the time interval from a time point g to a time point h, and the target torque tTE is limited by the threshold torque tTELMT. By determining the target throttle opening degree tTVO from the threshold torque tTELMT, the control system can hold the actual throttle opening degree TVO (=tTVO) approximately constant in the interval between g and h, as long as the engine speed is not varied so much. Thus, the limitation of the target throttle opening to the value corresponding to the threshold torque tTELMT prevents undesired oscillation of the throttle opening. The control system can ensure a good driveability even in an accelerating operation with the accelerator pedal being depressed partly short of the fully open position.

The limitation of the target throttle opening degree by the degree corresponding to the threshold torque tTELMT decreases the torque the engine can achieve. The amount of this decrease in the engine torque is only several % of the maximum torque or less, so that this system can still maintain sufficient engine performance.

Thus, the control system according to this embodiment controls the throttle opening degree in the normal, torque responsive, control mode in the lower target torque range in which tTE<tTELMT. In the higher target torque range in which tTE≧tTELMT, the throttle opening degree is controlled in the special or torque independent constraint mode. When the target torque tTE becomes equal to or greater than tTELMT, the control system switches the control mode from the normal torque responsive control mode to the accelerator opening dependent mode of the step S11 or to the threshold limiting control mode of the step S10, and thereby prevent undesired oscillation of the throttle opening degree.

When the driver demands the maximum engine torque by depressing the accelerator pedal to the fully open position of the maximum accelerator opening degree, the control system fully opens the throttle valve and thereby make the best use of the engine output capability.

Figure 6:
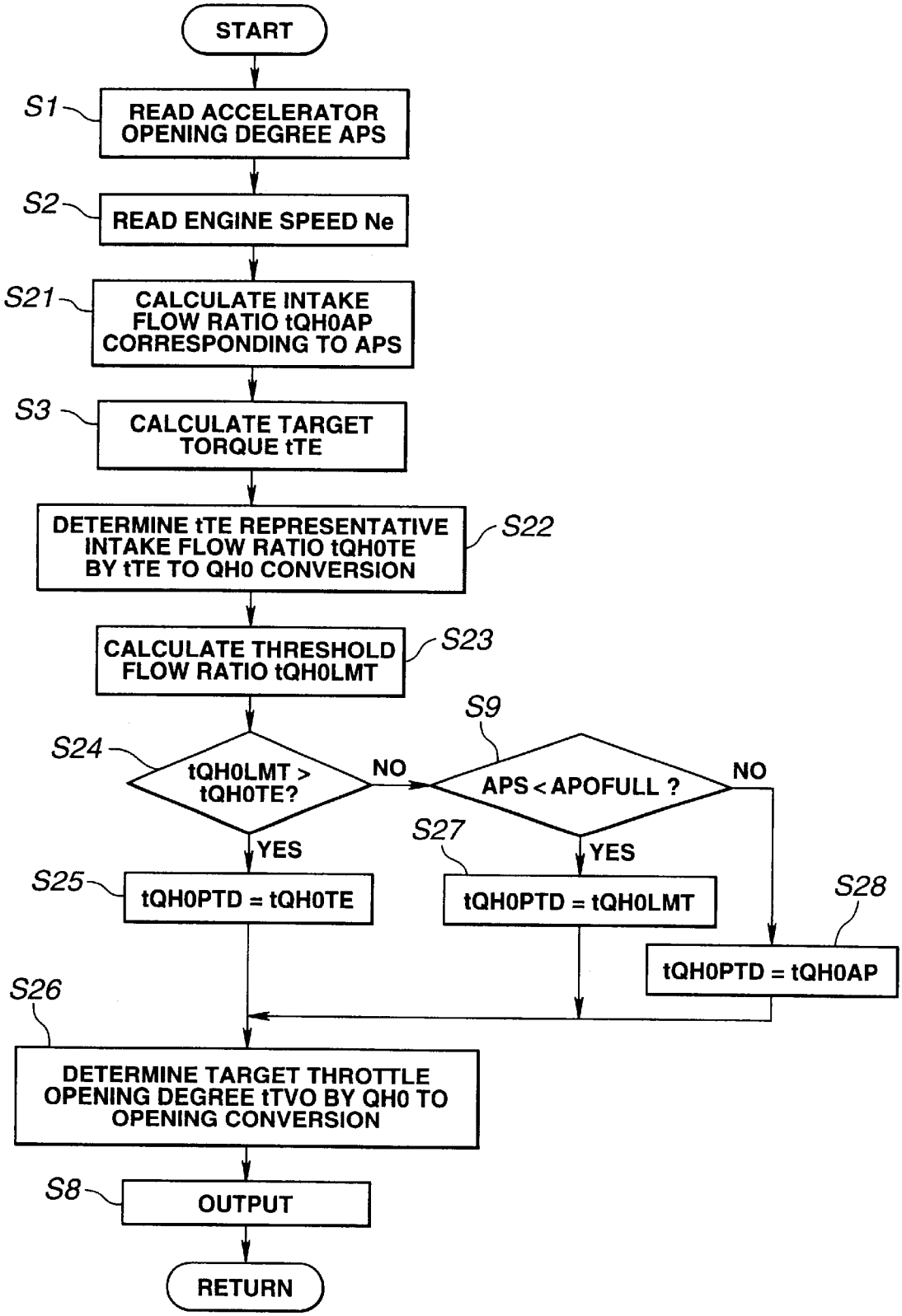
FIG. 6 is a flowchart showing a throttle opening control process according to a second embodiment of the present invention.

FIG. 6 shows a control process according to a second embodiment of the present invention. The engine system according to the second embodiment is the same, in hardware configuration, as that of the first embodiment as shown in FIG. 1. Steps S1~S3 and S8 are substantially identical to the steps S1~S3 and S8 of FIG. 2. In the second embodiment, an intake air flow ratio (QH0) is used as a target torque representative quantity representing the target torque, in place of the target engine torque. The process of FIG. 6 is different from the process of FIG. 2 in the following points.

Figure 7:
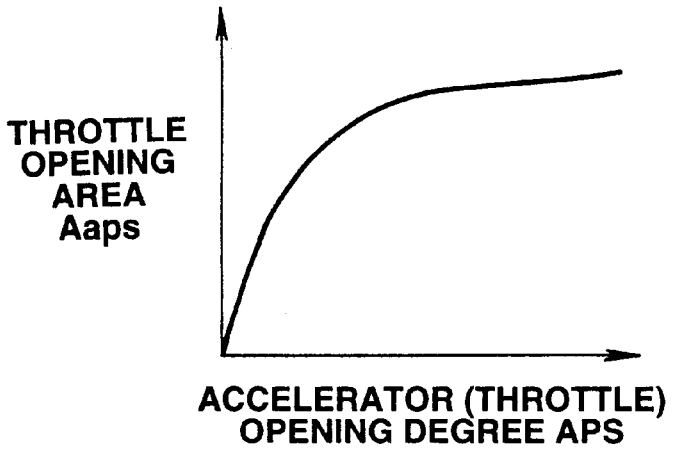
FIG. 7 is a graph showing a characteristic of a throttle valve opening area with respect to an accelerator opening degree, for use in the control process of FIG. 6.

At a step S21 interposed between the steps S2 and S3, the control unit 11 calculates an intake air flow ratio tQH0AP corresponding to the accelerator opening degree. The method for determining tQH0AP employed in this example is as follows:

(i) First, a throttle valve opening area Aaps is calculated by supposing the accelerator opening degree APS to be the throttle opening degree. In this example, the control unit 11 determines the throttle valve opening area Aaps by lookup from a table storing a relationship of the throttle valve opening area Aaps with respect to the accelerator opening degree APS as shown in FIG. 7.

(ii) Then, a normalized throttle valve opening area ADNVAP is determined by dividing the throttle valve opening area Aaps by the engine revolution speed Ne and a displacement VOL of the engine 1.

$$ADNVAP=Aaps/Ne/VOL \quad \text{[Eq. 2-1]}$$

Figure 8:
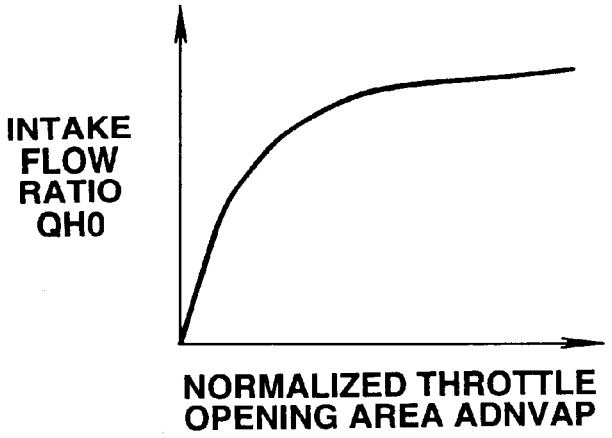
FIG. 8 is a graph showing a characteristic of an intake air flow rate with respect to a normalized opening area, for use in the control process of FIG. 6.

(iii) The intake air flow ratio tQH0AP corresponding to the accelerator opening degree APS is determined from the normalized throttle opening area ADNVAP by using a relationship of an intake air flow ratio QH0 with respect to ADNVAP as shown in FIG. 8. In this example, the control unit 11 determines the intake air flow ratio tQH0AP by lookup from a table of function values as shown in FIG. 8.

Figure 9:
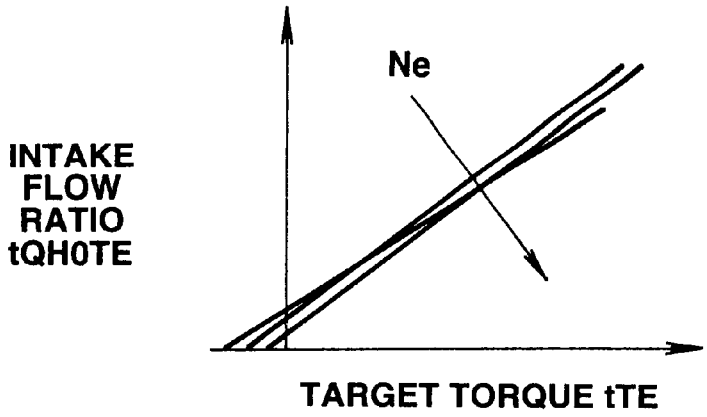
FIG. 9 is a graph showing a characteristic of a target torque representative intake flow ratio, for use in the control process of FIG. 6.

A step S22 following the step S3 is a step for calculating an intake air flow ratio tQH0TE corresponding to the target torque tTE determined at the step S3. In this example, the control unit 11 determines the intake air flow ratio tQH0TE from the engine speed Ne and the target torque tTE by lookup from a map as shown in FIG. 9. The intake flow ratio tQH0TE increases as the target torque tTE increases.

After the step S22, the control unit 11 determines a threshold flow ratio tQH0LMT at a step S23, and compares the target torque corresponding flow rate ratio tQH0TE with this threshold flow ratio tQH0LMT at a step S24.

The function of the threshold flow ratio tQH0LMT is substantially the same as that of the threshold torque tTELMT according to the first embodiment. The torque corresponding to the threshold flow ratio tQH0LMT is equal to the threshold torque tTELMT as superimposed in FIGS. 4C–D and 5C–D.

Figure 10:
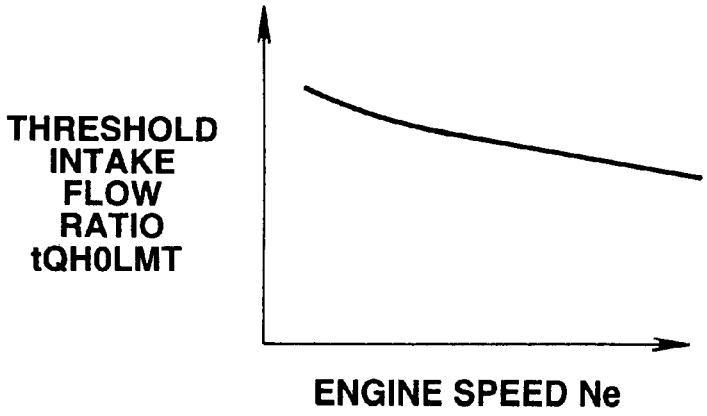
FIG. 10 is a graph showing a characteristic of a threshold of the target torque representative intake flow ratio.

The threshold flow ratio tQH0LMT of this example is a function of the engine speed like the threshold torque tTELMT, for the same reason. In this example, the control unit 11 determines the threshold flow ratio tQH0LMT in accordance with the engine speed by lookup from a table storing a functional relationship as shown in FIG. 10. In the example shown in FIG. 10, tQH0LMT decreases monotonically with increase in Ne. The reason for varying the threshold tQH0LMT in dependence on the engine speed is the same as the reason for the dependence of the threshold tTELMT on the engine speed. As in the first embodiment, it is optional to employ a constant value as the threshold flow ratio tQH0LMT for simplification.

When the target torque representative (or corresponding) intake flow ratio tQH0TE is smaller than the threshold flow ratio tQH0LMT, the control unit 11 proceeds from the step S24 to a step S25, to perform the normal throttle control. The control unit 11 stores the target torque representing flow ratio tQH0TE as a second (final) target torque representative intake flow ratio labeled tQH0PTD at the step S25, and determines the target throttle opening degree tTVO in accordance with the thus-obtained second target torque representative intake flow ratio tQH0PTD at a step S26.

The calculation of the target throttle opening degree tTVO at the step S26 is in the form of an inverse operation of the step S21.

(iv) From the second target torque representative intake flow ratio tQH0PTD, the control unit 11 in this example determines a normalized opening area ADNVPTD by lookup from the table of the relationship of FIG. 8.

(v) Then, the control unit 11 determines a target throttle valve opening area tATVO by multiplying the normalized opening area ADNVPTD by the engine speed Ne and the displacement VOL in the manner converse to the equation 2-1.

$$tATVO=ADNVPTD\times Ne\times VOL \quad \text{[Eq. 2-2]}$$

(vi) From this target throttle valve opening area tATVO, the control unit 11 determines the target throttle valve opening degree tTVO by using the table storing the relationship of FIG. 7.

When the target torque representative intake flow ratio tQH0TE is equal to or greater than the threshold flow ratio tQH0LMT, the control unit 11 proceeds from the step S24 to the step S9. When tQH0TE≧tQH0LMT and APS<APOFULL, then the control unit 11 proceeds from the step S9 to a step S27, stores the threshold flow ratio tQH0LMT as the second (final) target torque representative intake flow ratio tQH0PTD at the step S27, and then performs the operations of the steps S26 and S8. Therefore, at the step S26, the target throttle valve opening degree tTVO is set equal to the throttle opening degree corresponding to the threshold flow ratio tQH0LMT.

When tQH0TE≧tQH0LMT and APS≧APOFULL, the control unit 11 proceeds from the step S9 to a step S28, stores the accelerator opening degree corresponding intake flow ratio tQH0AP directly as the second (final) target torque representative intake flow ratio tQH0PTD at the step S28, and performs the operations of the steps S26 and S8.

In the second embodiment substituting the target torque representative intake flow ratio (as the target torque representative quantity) for the target torque, as shown in FIGS. 4C–D and 5C–D, the torque corresponding to tQH0LMT is equal to tTELMT and the throttle valve opening degree corresponding to tQH0LMT is equal to the throttle valve opening degree TVO corresponding to tTELMT. The control system according to the second embodiment can achieve the same effects as in the first embodiment.

It is desirable to set the threshold accelerator opening degree APOFULL greater than the accelerator opening degree corresponding to tTELMT (in the case of the first embodiment as mentioned before) or than the accelerator opening degree corresponding to tQH0LMT (in the second embodiment) in order to prevent an unwanted decrease in the throttle opening degree as illustrated in FIGS. 11A–11F.

Figure 11A:
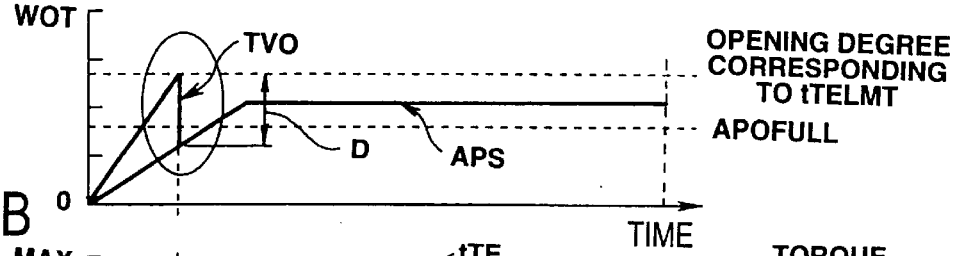
FIGS. 11A–11F are graphs for illustrating effects of the control process of FIG. 6.
Figure 11B:
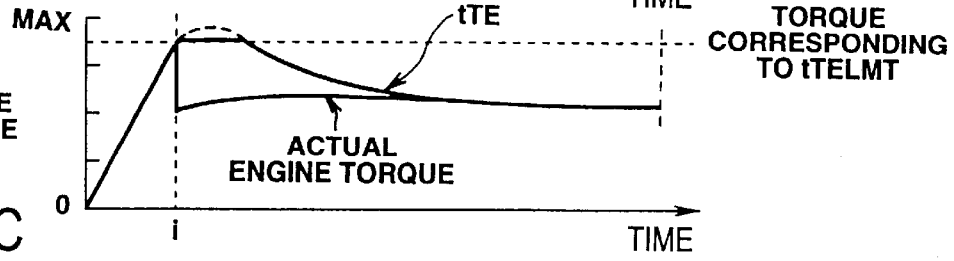
Figure 11C:
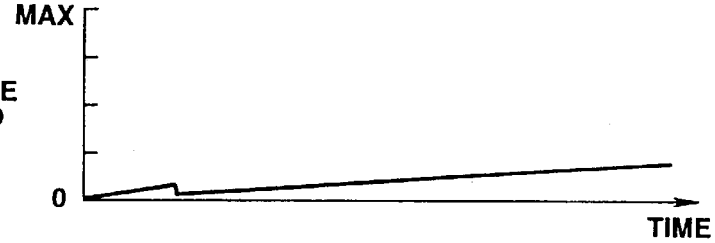

In the example of FIGS. 11A–11C, the threshold accelerator opening degree APOFULL is smaller than the accelerator opening degree corresponding to tTELMT (or corresponding to tQH0LMT in the second embodiment). In this case, in dependence on the setting of the target torque, the throttle valve can move unwantedly in the closing direction during the process of acceleration. Just before a time point i shown in FIGS. 11A–11B, the throttle opening degree TVO is greater than the accelerator opining degree. The requirements of tTE≧tTELMT (or tQH0TE≧tQH0LMT in the second embodiment) and APS≧APOFULL are satisfied at the time point i shown in FIGS. 11A–11B. Therefore, the target throttle valve opening tTVO is set equal to the then existing accelerator opening degree (by the step S11). As a result, the throttle opening degree is decreased in the form of a step D shown in FIG. 11A from the greater value just before the time point i to the smaller value determined by the accelerator opening degree. This decrease of the throttle opening degree causes a decrease of the actual engine torque and discontinuity of the vehicle speed, deteriorating the driveability.

Figure 11D:
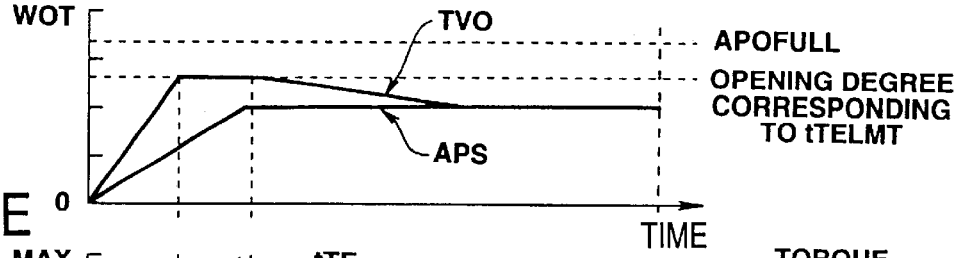
Figure 11E:
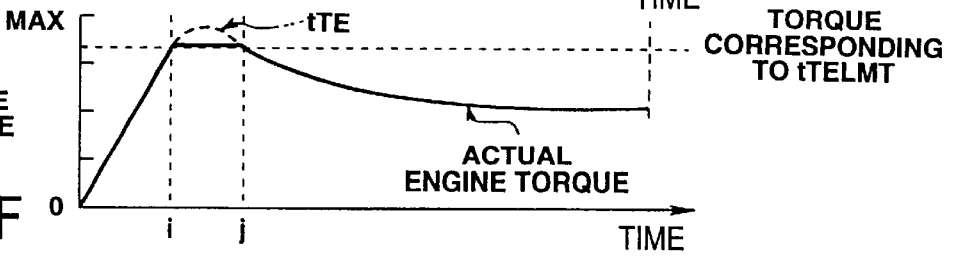
Figure 11F:
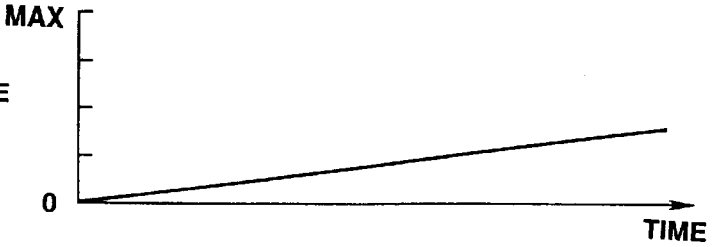

In the example of FIGS. 11D–11F, by contrast, the threshold accelerator opening degree APOFULL is greater than the accelerator opening degree corresponding to tTELMT (or corresponding to tQH0LMT in the second embodiment). In this case, the requirement of APS≧APOFULL is not satisfied at the time point i in the same driving situation. The control system acts to merely maintain the then existing throttle opening degree (that is, the throttle opening degree corresponding to tTELMT), so that the throttle valve does not move like a step change in the closing direction. Thus, the setting of the threshold accelerator opening degree APOFULL at a value greater than the accelerator opening degree corresponding to tTELMT (or corresponding to tQH0LMT in the second embodiment) is effective in preventing an unwanted movement of the throttle valve in the closing direction during accelerating operation with the accelerator pedal being depressed only to a partial degree.

Figure 12:
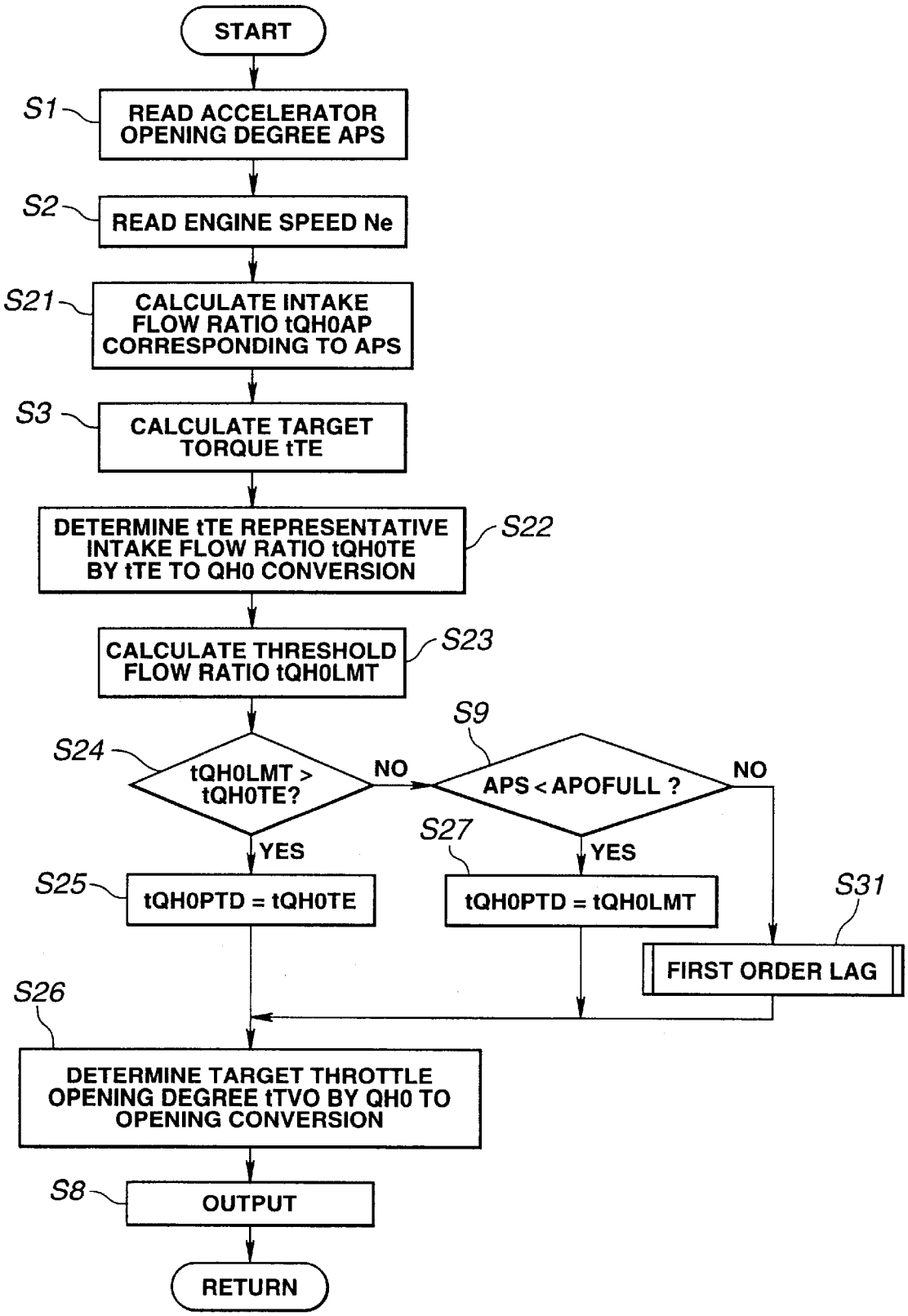
FIG. 12 is a flowchart showing a throttle opening control process according to a third embodiment of the present invention.

FIG. 12 shows a control process according to a third embodiment of the present invention. The process of FIG. 12 is substitutable for the process of FIG. 6. FIG. 12 is different from FIG. 6 in a step S31, and substantially the same in the other respects. The step S28 in FIG. 6 is replaced by the step S31 for a first order lag (or delay) operation.

When tQH0TE≧tQH0LMT and APS≧APOFULL, the control unit 11 proceeds to the step S31, and performs a first order lag operation.

In the second embodiment, the control system varies the target throttle opening degree tTVO steeply like a step change at the time point c from the value corresponding to tQH0LMT to the value corresponding to tQH0AP (that is, the fully open throttle valve position WOT). Therefore, the throttle valve opens abruptly, and increases the noise of intake air stream.

Figure 14A:
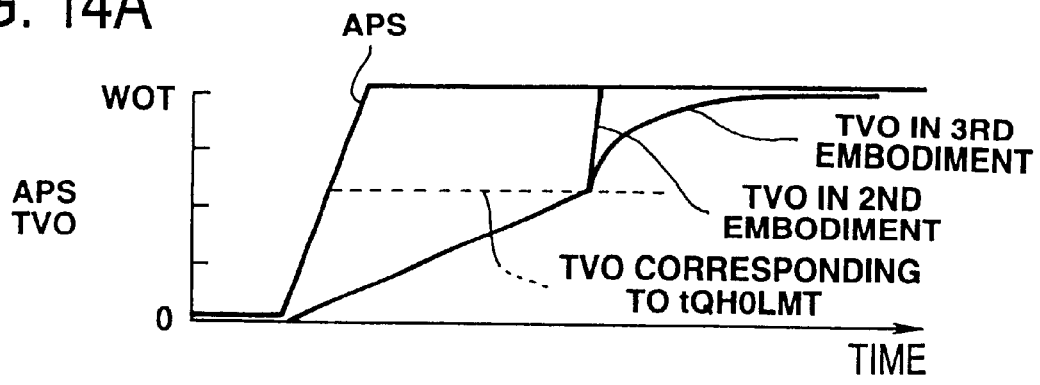
FIGS. 14A and 14B are views showing effects of the control process of FIG. 12.
Figure 14B:
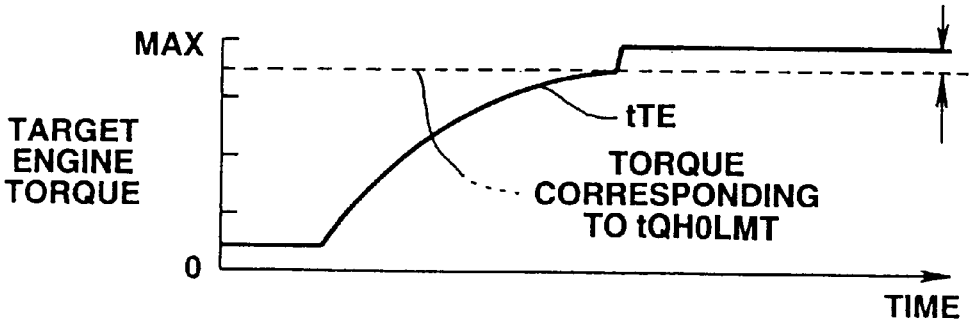

To avoid this, the control system according to the third embodiment is programmed to vary the target throttle opening degree gradually in the form of a first order lag as shown in FIGS. 14A and 14B from the value corresponding to tQH0LMT to the value corresponding to the then-existing value of tQH0AP.

Figure 13:
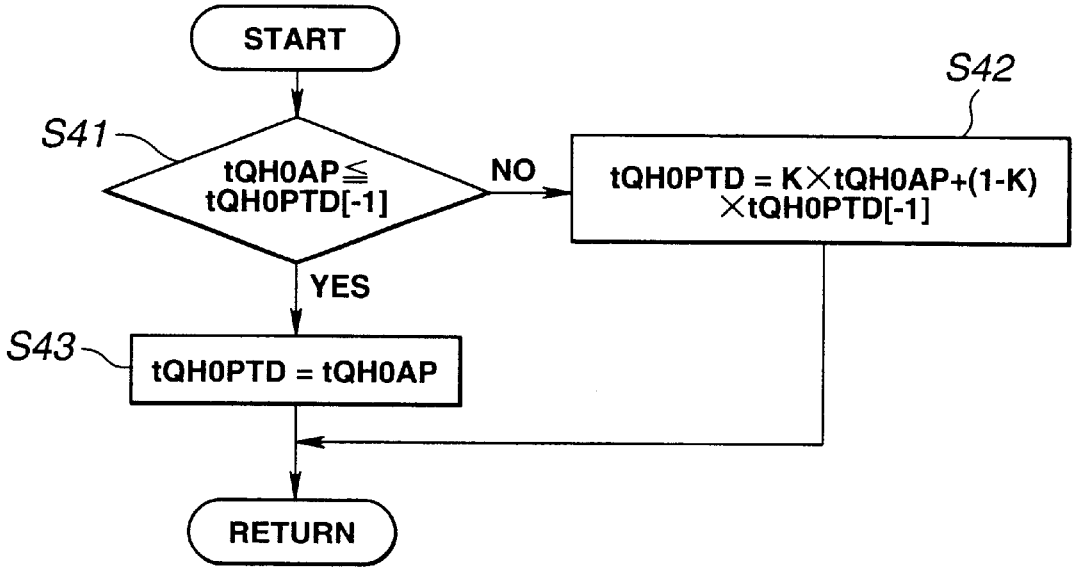
FIG. 13 is a flowchart for illustrating an operation of first order lag, used in the process of FIG. 12.

FIG. 13 shows the first order lag operation (a subroutine of the step S31). The subroutine of FIG. 13 is performed at regular time intervals of a predetermined cycle.

At a step 541, the control unit 11 compares the accelerator opening corresponding intake flow ratio tQH0AP and a previous second target torque corresponding intake flow ratio tQH0PTD-$_{-1}$ (indicated as tQH0PTD[−1] in FIG. 13) which is a previous value of the target torque corresponding intake flow ratio tQH0PTD determined in a previous operation cycle, one cycle before. When tQH0AP≧tQH0PTD$_{-1}$, the control unit 11 proceeds from the step S41 to a step S42, and updates the second target torque corresponding intake flow ratio tQH0PTD by using the following equation of a first order lag.

$$tQH0PTD=K\times tQH0AP+(1-K)\times tQH0PTD_{-1} \quad \text{[Eq. 3]}$$

In this equation, K is a weight coefficient for a weighted average.

The second target torque corresponding intake flow ratio tQH0PTD determined by this equation approaches tQH0AP in the form of a first order lag from the value of tQH0TE or tQH0LMT. Therefore, when the accelerator pedal is depressed fully as in the example of FIGS. 4A–4D, the target throttle opening degree tTVO is increased gradually in the form of a first order lag to the value of the fully open throttle position WOT from the initial value which is the value corresponding to tQH0LMT.

When tQH0AP s tQH0PTD-$_{-1}$, the control unit 11 proceeds from the step S41 to a step S43, and stores the accelerator opening corresponding intake flow ratio tQH0AP directly as the second target torque corresponding intake flow ratio tQH0PTD. In this case, the target throttle opening degree becomes equal to the value of the fully open throttle position WOT.

When the requirements of tQH0TE≧tQH0LMT and APS≧APOFULL are satisfied, the control system according to the third embodiment increases the target throttle opening degree tTVO gradually, and thereby prevents an abrupt opening movement of the throttle valve.

In the example of FIG. 13, the first order lag operation is implemented by the operation of the weighted average. It is, however, optional to employ technique of time proportioning interior division. This operation is expressed as:

$$tQH0PTD=\alpha\times tQH0AP+(1-\alpha)\times tQH0PTD_{-1} \quad \text{[Eq. 4]}$$

This equation is similar to the equation 4 of the weighted average. In the equation 4, however, the coefficient a is a function of an elapsed time. In this example, $$\alpha=t/T \quad \text{[Eq. 5]}$$

where t is elapsed time, and T is a time required for a changeover (which can be set equal to a desired constant value). When T=10 seconds, a becomes equal to one ($\alpha$=1) and tQH0PTD becomes equal to tQH0AP after the elapse of 10 seconds from the beginning of the changeover.

In the time proportioning interior division method, it is possible to hold the time required for a changeover constant independently of the difference between values before and after a changeover. In the weighted average method, the time for a changeover remains unchanged if the weight coefficient is constant. However, the time for a changeover is varied by variation in the difference between values before and after a changeover.

The technique of the third embodiment is applicable to the first embodiment.

Although the invention has been described above by reference to certain embodiments of the invention, the invention is not limited to the embodiments described above. Modifications and variations of the embodiments described above will occur to those skilled in the art in light of the above teachings.

The target torque representative quantity is the target torque tTE in the first embodiment, and the target torque representative intake flow ratio in the second embodiment. Moreover, the target torque representative quantity according to the present invention may be a relative value determined by treating the maximum torque as 100%.

The engine 1 shown in FIG. 1 has a fuel injector 8 inserted into each combustion chamber, and the engine 1 is capable of performing a stratified charge combustion. The present invention is not limited to such a direct fuel injection type engine. The present invention is applicable to engines of various other types, such as engines having a fuel injector in an intake port.

This application is based on a Japanese Patent Application No. 10-263352. The entire contents of this Japanese Patent Application No. 10-263352 with a filing date of Sep. 17, 1998 are hereby incorporated by reference.

The scope of the invention is defined with reference to the following claims.

What is claimed is:

1. An engine control apparatus comprising:

an actuator that controls an actual throttle opening degree in response to a throttle control signal;

an accelerator input device that produces an accelerator signal representing an accelerator opening degree varying from a minimum degree to a maximum degree corresponding to a throttle opening degree of a fully open throttle valve position;

a target quantity calculating section that calculates a target torque representative quantity representative of a target torque in accordance with the accelerator opening degree represented by the accelerator signal;

a first target opening determining section that calculates a first mode target throttle opening degree in accordance with the target torque representative quantity;

an output section that determines a desired target throttle opening degree in accordance with the first mode target throttle opening degree and for producing the throttle control signal in accordance with the desired target throttle opening degree to reduce a deviation of the actual throttle opening degree from the desired target throttle opening degree;

a discriminating section that monitors the target torque representative quantity and the accelerator opening degree, and judges a first condition to be satisfied when the target torque representative quantity is equal to or greater than a threshold representative quantity, and the accelerator opening degree is equal to or greater than a threshold opening degree; and a second target opening determining section that determines a second mode target throttle opening degree as a function solely of the accelerator opening degree when the first condition is satisfied, and substitutes the second mode target throttle opening degree, as the desired target throttle opening degree, for the first mode target throttle opening degree when the first condition is satisfied.

2. An engine control apparatus as recited in claim 1 wherein said discriminating section judges a second condition to be satisfied when the target torque representative quantity is equal to or greater than the threshold representative quantity and the accelerator opening degree is smaller than the threshold opening degree, and the engine control apparatus further comprises a third target opening determining section for limiting the target torque representative quantity to the threshold representative quantity when the second condition is satisfied.

3. An engine control apparatus as recited in claim 1 wherein the threshold representative quantity is set equal to a minimum value of the target torque representative quantity within a region in which a rate of change of a throttle opening degree with respect to an engine torque is equal to or greater than a predetermined level.

4. An engine control apparatus as recited in claim 1 wherein the threshold opening degree for the accelerator opening degree is equal to or greater than a value of the accelerator opening degree corresponding to the threshold representative quantity for the target torque representative quantity.

5. An engine control apparatus as recited in claim 4 wherein the accelerator opening degree represented by the accelerator signal increases linearly with an actual accelerator opening degree of an accelerator of a vehicle up to the maximum degree equaling a maximum throttle opening degree.

6. An engine control apparatus as recited in claim 1 wherein the threshold representative quantity of the target torque representative quantity is determined in accordance with an engine speed.

7. An engine control apparatus as recited in claim 6 wherein the threshold opening degree is set equal to a greatest value among values of the accelerator opening degree corresponding to values of the threshold representative quantity determined in accordance with levels of the engine speed.

8. An engine control apparatus as recited in claim 1 wherein said second target opening determining section varies the desired target throttle opening degree gradually to the second mode target throttle opening degree when the first condition becomes satisfied.

9. An engine control apparatus as recited in claim 8 wherein said second target opening determining section performs a lag operation for introducing a lag when the desired target throttle opening degree represented by the throttle control signal is changed from the first mode target throttle opening degree to the second mode target throttle opening degree.

10. An engine control apparatus as recited in claim 8 wherein said second target opening determining section performs a lag operation for introducing a lag when the desired target throttle opening degree is changed to the second mode target throttle opening degree from a third mode target throttle opening degree determined by the third determining section in accordance with the threshold representative quantity of the target torque representative quantity.

11. An engine control apparatus as recited in claim 9 wherein the lag operation is an operation of time proportioning interior division.

12. An engine control apparatus as recited in claim 1 wherein when the discriminating section determines that the target torque representative quantity is equal to or greater than the threshold representative quantity, and the accelerator opening degree is smaller than the threshold degree, a limiting section limits the target torque representative quantity to the threshold representative quantity.

13. An engine control apparatus as recited in claim 12 wherein the threshold opening degree for the accelerator opening degree is equal to or greater than a value of the accelerator opening degree corresponding to the threshold representative quantity for the target torque representative quantity, and wherein the threshold representative quantity of the target torque representative quantity is decreased as an engine speed increases.

* * * * *